US006412662B1

(12) United States Patent
Bryan et al.

(10) Patent No.: US 6,412,662 B1
(45) Date of Patent: Jul. 2, 2002

(54) HOT MELT ADHESIVE HAND APPLICATOR

(75) Inventors: Christopher D. Bryan, Morristown, NJ (US); Daniel D. Bourget; Paul J. Donley, both of Hendersonville, TN (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/947,476

(22) Filed: Sep. 7, 2001

(51) Int. Cl.[7] ..... B67D 5/62
(52) U.S. Cl. ..... 222/146.5
(58) Field of Search ..... 222/146.5, 153.14, 222/323, 473, 529; 239/528, 526, 530

(56) References Cited

U.S. PATENT DOCUMENTS 1,929,662 A * 10/1933 Wappat ..... 222/153.14
3,780,953 A * 12/1973 Malec ..... 239/526
3,847,233 A * 11/1974 Glover et al. ..... 222/153.14
3,913,844 A * 10/1975 Petrovic ..... 239/526
3,971,492 A * 7/1976 Lockwood ..... 222/146.5
4,245,759 A * 1/1981 Baker et al. ..... 222/146.5
5,236,129 A * 8/1993 Grime et al. ..... 239/528
5,803,313 A 9/1998 Flatt et al.

* cited by examiner

*Primary Examiner*—Philippe Derakshani
*Assistant Examiner*—Thach H. Bui
(74) *Attorney, Agent, or Firm*—Schwartz & Weinrieb

(57) ABSTRACT

An applicator gun for dispensing hot melt adhesive comprises a hydraulic material supply hose connection, an electrical power cable connection, and a hanger bracket connection. The hose connection may be inverted, and the power cable and hanger bracket connections interchanged so as to provide the applicator gun with different orientation capabilities. The applicator gun may also alternatively accommodate four-finger and two-finger trigger members, and the gun may be connected to the hose connection so as to be movable in alternative modes comprising rotation around a single linear axis or universal movement within six degrees of freedom. The gun also comprises a trigger lock mechanism comprising detent members which provide the operator with tactile indications of the trigger lock mechanism being disposed at LOCKED and UNLOCKED positions, and an enclosed weep hole or window is provided within a side portion of the gun housing so as to alert the operator to hydraulic material leakage prior to the leaking hydraulic material fouling component parts of the gun.

49 Claims, 6 Drawing Sheets

HOT MELT ADHESIVE HAND APPLICATOR

FIELD OF THE INVENTION

The present invention relates generally to hot melt adhesive hand applicators, and more particularly to a new and improved hot melt adhesive hand applicator comprising various structural components which provide the applicator with a desired degree of operative diversity and versatility, and which also provides the applicator with improved safety and preventive maintenance features.

BACKGROUND OF THE INVENTION

In connection with hot melt adhesive hand applicators, the applicator or gun is normally provided with several operative connections, such as, for example, a first inlet hose is operatively connected to the applicator or gun for introducing the hydraulic or adhesive fluid material under pressure into the applicator or gun, and a second hose or cable is operatively connected to the applicator or gun for providing the same with electrical power in order to energize a heater body assembly which is provided for heating the incoming hydraulic or adhesive fluid material in order to enable the same to be dispensed from the applicator or gun as hot melt adhesive. Depending upon the particular assembly line or production line being used within a particular facility, or depending upon the particular assembly line or production line being used in connection with particular production applications, it is often desirable that the applicator or gun be capable of being used in various different modes of operation, or that the applicator or gun be capable of undergoing different movements having different degrees of freedom, or still further, that the applicator or gun be capable of being used in various different orientations.

For example, the applicator gun may be further provided with a hanger clip or bracket, and it may sometimes be desired that the applicator gun be utilized in a conventional gun-type mode of operation wherein the handle of the gun is pointing or oriented downwardly while the hydraulic adhesive material hose is disposed in a suspended mode and is operatively connected to an upper surface region of the heater body housing of the applicator gun, the electrical power cable is likewise disposed in a suspended mode and is operatively connected to an upper surface region of the applicator gun housing disposed above the handle housing, and the hanger clip or bracket is operatively mounted upon a lower region of the gun handle housing. Alternatively, it may be desired to utilize the applicator gun in a conventional gun-type mode of operation wherein the handle of the gun is pointing or oriented downwardly, however, the hydraulic adhesive material hose is disposed in a downwardly extending mode and is operatively connected to a lower surface region of the heater body housing of the applicator gun, the electrical power cable is likewise disposed in a downwardly extending mode and is operatively connected to an lower surface region of the applicator gun housing disposed beneath the handle housing, and the hanger clip or bracket is operatively mounted upon an upper region of the gun handle housing.

In addition, the hydraulic adhesive material hose may be disposed in a downwardly extending mode so as to be operatively connected to a lower surface region of the heater body housing of the applicator gun, the electrical power cable may likewise be disposed in a downwardly extending mode so as to be operatively connected to a lower surface region of the applicator gun housing disposed beneath the handle housing, and the hanger clip or bracket is operatively mounted upon an upper region of the gun handle housing, however, the applicator gun is effectively disposed in an upside down or inverted orientation. Alternatively, the applicator gun is effectively disposed in an upside down or inverted orientation, however, the hydraulic adhesive material hose may be disposed in an upwardly extending mode so as to be operatively connected to an upper surface region of the heater body housing of the applicator gun, the electrical power cable may likewise be disposed in an upwardly extending mode so as to be operatively connected to an upper surface region of the applicator gun housing disposed above the handle housing, and the hanger clip or bracket is operatively mounted upon a lower region of the gun handle housing. In a similar manner, different operator personnel may opt to utilize what are known in the industry as four-finger trigger mechanisms or two-finger trigger mechanisms, and still yet further, in order to easily facilitate the utilization of the applicator gun in a variety of different orientations required in connection with the application of adhesive to, for example, different portions or regions of different products, it is sometimes desirable that the applicator gun be freely movable around a rotary axis, or alternatively, it is sometimes desirable that the applicator gun be freely movable in a universal mode with six degrees of freedom.

While PRIOR ART applicator guns have exhibited structural features which enable such applicator guns to achieve one or more of the various aforenoted desirable operative modes or capabilities, no single applicator gun has ever had structural features incorporated therein which enable the applicator gun to achieve all of the various aforenoted desirable operative modes or capabilities. A need therefore exists in the art for a new and improved applicator gun wherein the gun is readily capable of being operated in a normal gun-type mode with the hydraulic hose and electrical power cable connections capable of extending upwardly or downwardly with respect to the gun, wherein the gun is readily capable of being operated in an upside down or inverted mode with the hydraulic hose and electrical power cable connections capable of extending upwardly or downwardly with respect to the gun, wherein the gun is capable of being operated by means of a four-finger trigger mechanism or by means of a two-finger trigger mechanism, and lastly, wherein the gun is capable of being operated so as to be freely movable around a rotary axis, or alternatively, to be freely movable in a universal mode with six degrees of freedom.

OBJECTS OF THE INVENTION

Accordingly, it is an object of the present invention to provide a new and improved hot melt adhesive applicator gun.

Another object of the present invention is to provide a new and improved hot melt adhesive applicator gun which effectively overcomes the various operative disadvantages or drawbacks characteristic of PRIOR ART hot melt adhesive applicator guns.

An additional object of the present invention is to provide a new and improved hot melt adhesive applicator gun which can effectively be operative in accordance with different operative orientations.

A further object of the present invention is to provide a new and improved hot melt adhesive applicator gun which can effectively be operative in accordance with different operative orientations of the applicator gun, in accordance with different operative connections of the hydraulic hose and electrical power cable to the applicator gun, in accordance with different movement modes of the applicator gun with respect to a rotary axis or in accordance with six degrees of freedom, and wherein the gun is capable of being operated with either a four-finger trigger mechanism or a two-finger trigger mechanism.

A last object of the present invention is to provide a new and improved hot melt adhesive applicator gun wherein the gun is readily capable of being operated in a normal gun-type mode with the hydraulic hose and electrical power cable connections capable of extending upwardly or downwardly with respect to the gun, wherein the gun is readily capable of being operated in an upside down or inverted mode with the hydraulic hose and electrical power cable connections capable of extending upwardly or downwardly with respect to the gun, wherein the gun is capable of being operated by means of a four-finger trigger mechanism or by means of a two-finger trigger mechanism, and lastly, wherein the gun is capable of being operated so as to be freely movable around a rotary axis, or alternatively, to be freely movable in a universal mode with six degrees of freedom.

SUMMARY OF THE INVENTION

The foregoing and other objectives are achieved in accordance with the teachings and principles of the present invention through the provision of a new and improved hot melt adhesive applicator gun wherein the gun comprises a handle housing with upper and lower parts of the handle housing being integrally connected to upper and lower parts of an applicator gun housing. The handle housing and applicator gun housing are also formed from two mating half housing sections which are adapted to be fixed together by means of a plurality of screw fasteners. A heater body housing assembly, which also comprises a pair of two mating half housing sections fixed together by means of a screw fastener, is removably mounted upon a front portion of the applicator gun housing and has a heater body member incorporated therein. The heater body member is operatively connected to the applicator gun dispensing nozzle as well as to a stem fitting within which a stem is fixedly mounted for mating with the hydraulic material supply hose. The upper and lower parts of the applicator gun housing are also provided with flanged fittings by means of which a hanger bracket and an electrical cable connector are able to be mounted upon the applicator gun housing.

When the applicator gun and handle housing halves are taken apart and separated, the positions of the hanger bracket and the electrical cable connector relative to the applicator gun may be interchanged, and the heater body housing assembly may effectively be rotated 180° with respect to the dispensing nozzle axis. Accordingly, the applicator gun is able in effect to be disposed in either one of two different operative modes, that is, the applicator gun is able to be disposed in a normal gun-type mode with the hydraulic material hose and electrical power cable connections capable of extending upwardly or downwardly with respect to the gun, or alternatively, the applicator gun is able to be disposed in an upside down or inverted mode with the hydraulic hose and electrical power cable connections capable of extending upwardly or downwardly with respect to the gun. In addition, the gun is also capable of being operated by means of a four-finger trigger mechanism or by means of a two-finger trigger mechanism, and lastly, the heater body member of the applicator gun may comprise either axial rotation components enabling the applicator gun to be freely rotatable around a rotary axis, or the heater body member may comprise universal ball components enabling the applicator gun to be freely movable in a universal mode with six degrees of freedom. Still further, the applicator gun comprises improved weep hole structure which readily enables an operator to detect hydraulic material leakage prior to the same fouling the internal components of the applicator gun handle assembly, and a trigger lock assembly which is provided with unique detent structure for positively indicating to the operator the achievement of the locked and unlocked states of the trigger lock assembly.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
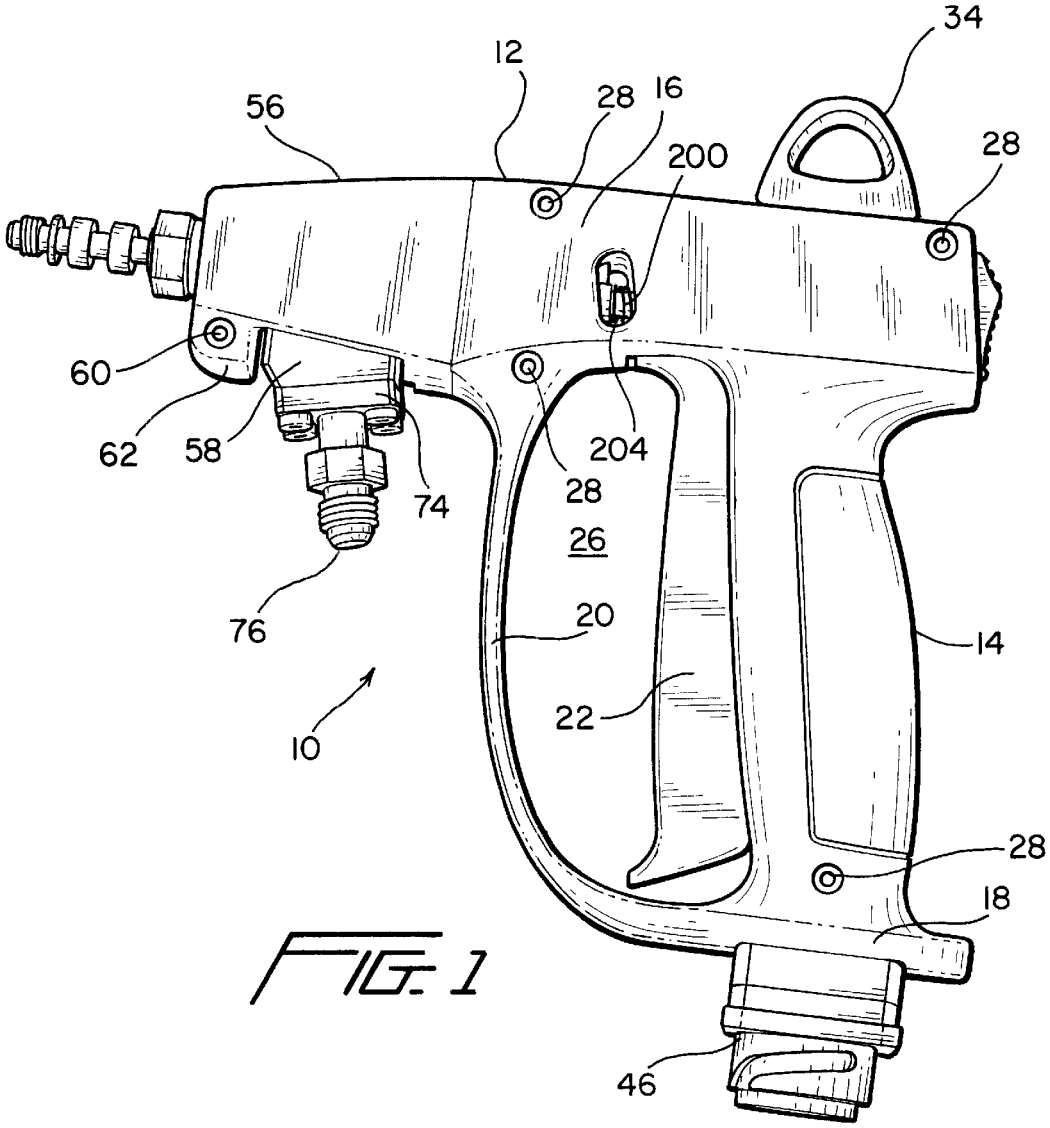
FIG. 1 is a side elevational view of a new and improved hot melt adhesive applicator gun constructed in accordance with the principles and teachings of the present invention and showing the cooperative parts thereof when the applicator gun is being used in a conventional gun-type mode of operation wherein the hydraulic material supply hose fitting and the electrical cable connector extend downwardly from the heater body housing assembly and the lower applicator gun housing portion disposed beneath the gun handle housing, respectively, the hanger bracket is mounted upon the upper applicator gun housing portion disposed above the gun handle housing, and a four-finger trigger mechanism has been incorporated within the applicator gun.
Figure 4:
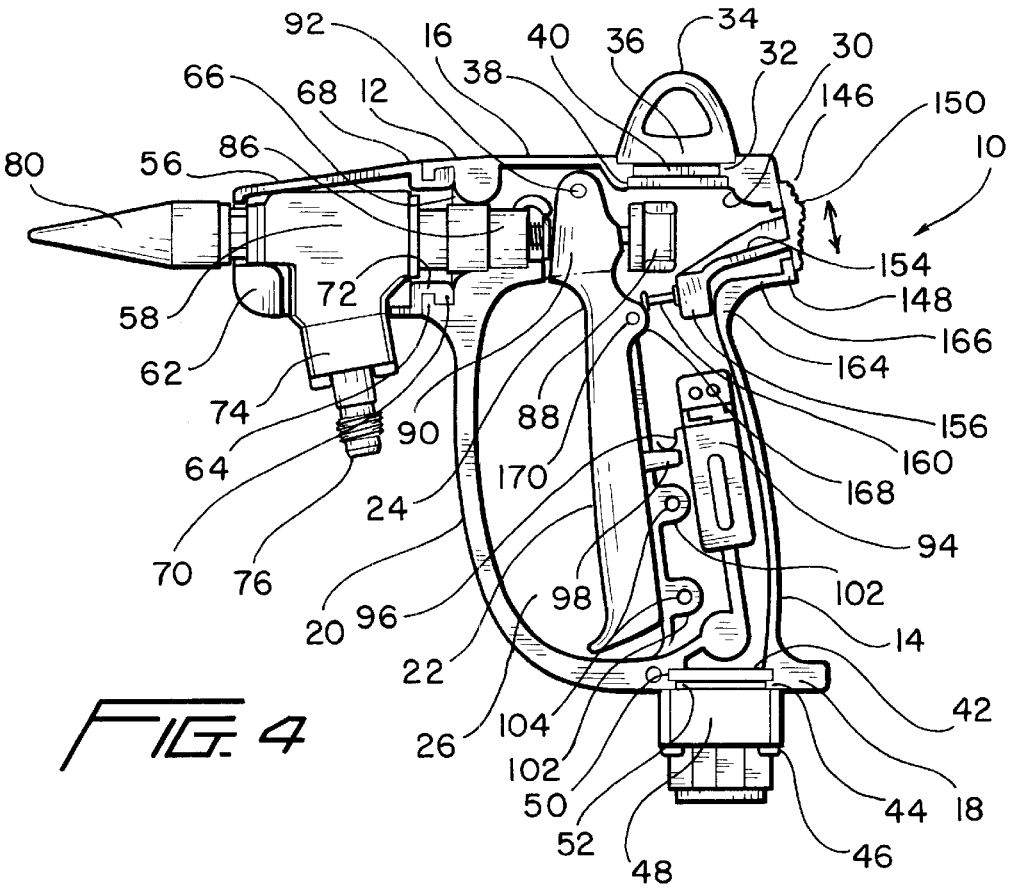
FIG. 4 is a side elevational view of the new and improved hot melt adhesive applicator gun illustrated within FIG. 3 wherein one of the integral applicator gun housing and handle housing halves has been removed so as to permit illustration of the internal components comprising the new and improved hot melt adhesive applicator gun.

Referring now to the drawings, and more particularly to FIG. 1 thereof, a new and improved hot melt adhesive dispensing applicator gun is disclosed and is generally indicated by the reference character 10. As can be readily seen and appreciated, the new and improved hot melt adhesive dispensing applicator gun 10 comprises an applicator gun housing 12 and a handle housing 14. More particularly, the applicator gun housing 12 comprises an upper applicator gun housing section 16, a lower applicator gun housing section 18, and a substantially L-shaped trigger cover housing section 20 which together with the applicator gun trigger member 22, of an applicator gun trigger assembly 24 which is best seen for example within FIG. 4, defines an open space 26 within which the operator can insert his fingers so as to in fact be able to readily and comfortably operate the applicator gun trigger member 22. As illustrated in FIG. 1, it is noted that the applicator gun trigger member 22 comprises a four-finger trigger member 22. It is noted further, as can best be appreciated, for example, from FIG. 4, that the integral applicator gun housing 12 and the handle housing 14 are both fabricated from or comprise mating half-housing sections which are adapted to be joined together along a vertical plane, as considered when the applicator gun 10 is disposed in its normal gun mode as seen in FIGS. 1 and 4, by means of a plurality of fasteners, for example, four fasteners, 28. Consequently, when the four fasteners 28 are removed from the applicator gun 10, the mating half-housing sections comprising the integral applicator gun housing 12 and the handle housing 14 can be separated so as to enable an operator to gain access to and expose the internal components of the applicator gun 10.

With reference continuing to be made to FIGS. 1 and 4, and in accordance with the first unique and novel feature characteristic of the present invention, it is seen that the upper applicator gun housing section 16 is provided with a first recessed portion 30 and includes a radially inwardly projecting flanged portion 32. A hanger bracket 34 comprises an upper base section 36, a lower radially outwardly projecting flanged section 38, and an annular radially recessed section 40 interposed between the upper base section 36 and the lower flanged section 38. As can be further seen from FIG. 4, the hanger bracket 34 is adapted to be mounted within the recessed portion 30 of the upper applicator gun housing section 16, and when this is accomplished, the upper base section 36 of the hanger bracket 34 will be seated upon and disposed above the radially inwardly projecting flanged portion 32 of the upper applicator gun housing section 16, the lower flanged section of the hanger bracket 34 will be disposed beneath the radially inwardly projecting flanged portion 32 of the upper applicator gun housing section 16, and the radially inwardly projecting flanged portion 32 of the upper applicator gun housing section 16 will be disposed within the annular radially recessed section 40 of the hanger bracket 34. Accordingly, when the non-illustrated mating half housing section comprising the integral applicator gun housing 12 and the handle housing 14 is fastened to the illustrated mating half housing section comprising the integral applicator gun housing 12 and the handle housing 14, the hanger bracket 34 will effectively be trapped within the applicator gun 10 and between the two mating half housing sections comprising the integral applicator gun housing 12 and the handle housing 14 so as to enable the applicator gun 10 to be suspended from a suitable support, not shown, when, for example, the applicator gun 10 is not being used.

In a similar manner, it is seen that the lower applicator gun housing section 18 is provided with a second recessed portion 42 and includes a radially inwardly projecting flanged portion 44. An electrical power cable connector 46 comprises a lower base section 48, an upper radially outwardly projecting flanged section 50, and an annular radially recessed section 52 interposed between the lower base section 48 and the upper flanged section 50. As can therefore be seen from FIG. 4, the electrical power cable connector 46 is adapted to be mounted within the recessed portion 42 of the lower applicator gun housing section 18, and when this is accomplished, the lower base section 48 of the electrical power cable connector 46 will be disposed beneath the flanged portion 44 of the lower applicator gun housing section 18, the upper radially outwardly projecting flanged section 50 of the electrical power cable connector 46 will be seated upon and disposed above the radially inwardly projecting flanged portion 44 of the lower applicator gun housing section 18, and the radially inwardly projecting flanged portion 44 of the lower applicator gun housing section 18 will be disposed within the annular radially recessed section 52 of the electrical power cable connector 46. Accordingly, when the non-illustrated mating half housing section comprising the integral applicator gun housing 12 and the handle housing 14 is fastened to the illustrated mating half housing section comprising the integral applicator gun housing 12 and the handle housing 14, the electrical power cable connector 46 will effectively be trapped within the applicator gun 10 so as to enable electrical power to be operatively transmitted to the applicator gun 10.

Figure 2:
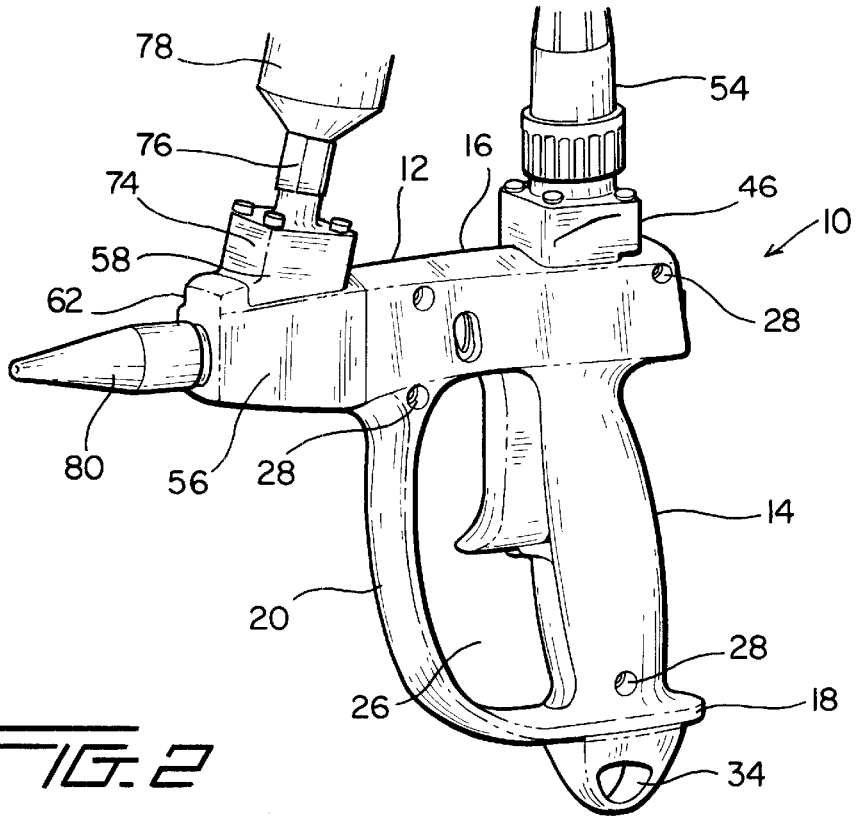
FIG. 2 is a perspective view of the new and improved hot melt adhesive applicator gun illustrated within FIG. 1 showing, however, the hydraulic material supply hose fitting and the hydraulic material supply hose, and the electrical cable connector and the electrical power cable, extending upwardly from the heater body housing assembly and the upper applicator gun housing portion disposed above the gun handle housing, respectively, while the hanger bracket is mounted upon the lower applicator gun housing portion disposed beneath the gun handle housing, and the four-finger trigger mechanism has been replaced with a two-finger trigger mechanism.

In connection with the aforenoted structure comprising the first and second recessed portions 30,42 and the radially inwardly projecting flanged portions 32,44 of the upper and lower applicator gun housing sections 16,18, respectively, as well as the structure comprising the base sections 36,48, the radially outwardly projecting flanged portions 38,50, and the annular radially inwardly recessed portions 40,52 of the hanger bracket 34 and the electrical power cable connector 46, respectively, it is to be appreciated that such structural components are substantially identical. Accordingly, when desired, and when the mating half housing sections comprising the integral applicator gun housing 12 and the handle housing 14 have been separated by removing the fasteners 28, the hanger bracket 34 may be removed from its disposition within the recessed portion 30 defined within the upper applicator gun housing section 16 and disposed within the recessed portion 42 defined within the lower applicator gun housing section 18, while the electrical power cable connector 46 may likewise in a reverse manner be removed from its disposition within the recessed portion 42 defined within the lower applicator gun housing section 18 and inserted within the recessed portion 30 defined within the upper applicator gun housing section 16. This interchangeability or exchange of such component parts of the applicator gun 10 can be best appreciated, for example, as a result of reference being made to FIGS. 2 and 3. It is additionally noted that the electrical power cable is illustrated in FIG. 2 at 54.

In a similar manner, and with reference again being made to FIGS. 1 and 4, it is seen that the applicator gun 10 is further provided with a heater body housing assembly which comprises a heater body housing 56 within which a heater body member 58 is disposed. As in the case of the integral applicator gun housing 12 and handle housing 14, the heater body housing 56 is fabricated from or comprises mating half-housing sections which are adapted to be joined together along a vertical plane, as considered when the applicator gun 10 is disposed in its normal gun mode as seen in FIGS. 1 and 4, by means of a fastener 60 which is mounted within mating lug portions 62 which are integrally formed upon left end portions of the mating halves of the heater body housing 56. The left end portion of each mating half of the upper applicator gun housing section 16 is provided with a vertically oriented, radially inwardly projecting flanged portion 64 and a recessed region 66. The right end portion of each mating half of the heater body housing 56 similarly comprises a vertically oriented radially inwardly projecting annular base section 68 and a vertically oriented radially outwardly projecting flanged portion 70 which is axially spaced from and cooperates with base section 68 in defining an annular recessed portion 72 therebetween. Accordingly, when each mating half of the heater body housing 56 is to be mounted within each recessed region 66 defined within each left end portion of each mating half of the upper applicator gun housing section 16, the radially inwardly projecting flanged portion 64 of each mating half of the upper applicator gun housing section 16 will be disposed within the annular recessed portion 72 of each mating half of the heater body housing 56, the base section 68 of each mating half of the heater body housing 56 will be disposed upon the left side of the radially inwardly projecting flanged portion 64 of each mating half of the upper applicator gun housing section 16, and the radially outwardly projecting flanged portion 70 of each mating half of the heater body housing 56 will be disposed upon the right side of the radially inwardly projecting flanged portion 64 of each mating half of the upper applicator gun housing section 16. Therefore, when the non-illustrated mating half of the upper applicator gun housing section 16 is mated with the illustrated mating half of the upper applicator gun housing section 16, the heater body housing 56 will effectively be trapped within the upper applicator gun housing section 16 so as to be fixedly mounted upon the applicator gun 10.

Figure 5:
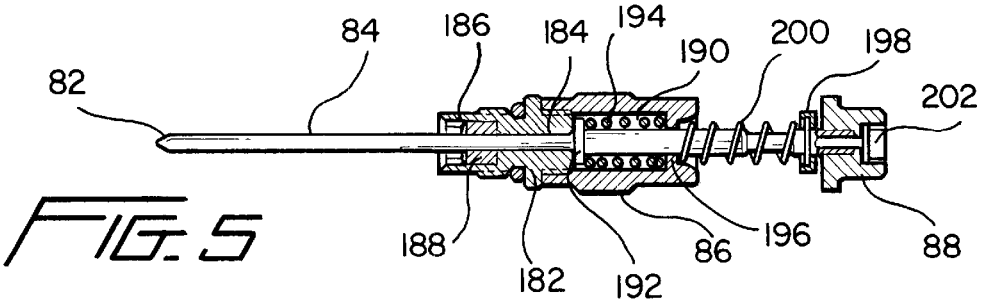
FIG. 5 is a partial cross-sectional view of a needle valve assembly utilized within the applicator gun of the present invention.

With reference continuing to be made to FIG. 4, the heater body member 58 has a stem fitting member 74 fixedly attached thereto, and the stem fitting member 74 is adapted to mount a stem or connector member 76 therein. The stem or connector member 76 is adapted to be operatively connected to a hydraulic material supply hose 78 which fluidically supplies the hydraulic or adhesive material to the applicator gun 10, the hydraulic material supply hose 78 being illustrated within FIG. 2. The applicator gun 10 is preferably provided with a tapered applicator nozzle 80, and a needle valve member 82, as best seen in FIG. 5, is operatively associated with nozzle 80 so as to control the dispensing or discharge of the hot melt adhesive material from the applicator gun 10. Part of the longitudinal shank portion 84 of the needle valve member 82 is housed internally within the heater body member 58 such that heated hydraulic or adhesive material is disposed therearound and thereby able to be controlled by the needle valve member 82 in conjunction with the dispensing or discharge of the heated hydraulic or adhesive material from the applicator nozzle 80 when the needle valve member 82 is unseated from its valve seat, not shown. The shank portion 84 of the needle valve member 82 passes through a needle valve return spring housing 86, and the opposite end of the needle valve shank portion 84 is fixed within a needle pull collar 88.

As best seen in FIG. 4, the upper end portion of the applicator gun trigger member 22 is provided with a forked portion comprising a pair of transversely spaced upstanding forked lug portions 90, only one of which is visible, and a rearward section of the needle valve shank portion 84 passes between the spaced upstanding forked lug portions 90. A transversely oriented dowel pin 92 passes through the upstanding forked lug portions 90 and has opposite ends thereof mounted within the mating half housing sections 16 so as to define a pivotal axis for the applicator trigger member 22. Accordingly, if the disposition or orientation of the heater body housing 56 as mounted upon the upper applicator gun housing section 16 is desired to be changed such that, for example, the heater body member 58, and its operatively connected hydraulic or adhesive material stem or connector member 76 and hose 78, are in turn to be changed from the downwardly dependent orientation of FIG. 1 to the upwardly extending orientation of FIG. 2, then the mating half housing sections comprising the integral applicator gun housing 12 and the handle housing 14 are initially separated by removing the fasteners 28, and dowel pin 92 of the applicator gun trigger member 22 is also removed.

This in effect permits the entire heater body housing 56, with the heater body member 58 and stem or connector 76, to be removed from recessed region 66 of the upper applicator gun housing section 16, and inverted 180°, along with nozzle 80, needle valve return spring housing 86, and needle pull collar 88, about the longitudinal axis defined by nozzle 80, housing 86, and collar 88. The heater body housing 56 can then be re-inserted into the recessed portion 66 of the upper applicator gun housing section 16, and upon re-installing dowel pin 92 and re-attaching the mating half housing sections comprising the integral applicator gun housing 12 and the handle housing 14, the heater body housing 56, heater body member 58, and hydraulic or adhesive material stem or connector member 76 and hose 78, will be fixedly secured at their new orientation or disposition illustrated in FIG. 2. It can thus be appreciated that the orientation or disposition of the hydraulic or adhesive material supply hose 78 can be readily and quickly altered in a manner similar to that previously discussed in connection with the alteration of the orientation and disposition of the hanger bracket 34 and the electrical power cable 54 so as to accommodate, for example, various spatial or other requirements unique to a particular production facility or production line.

Figure 3:
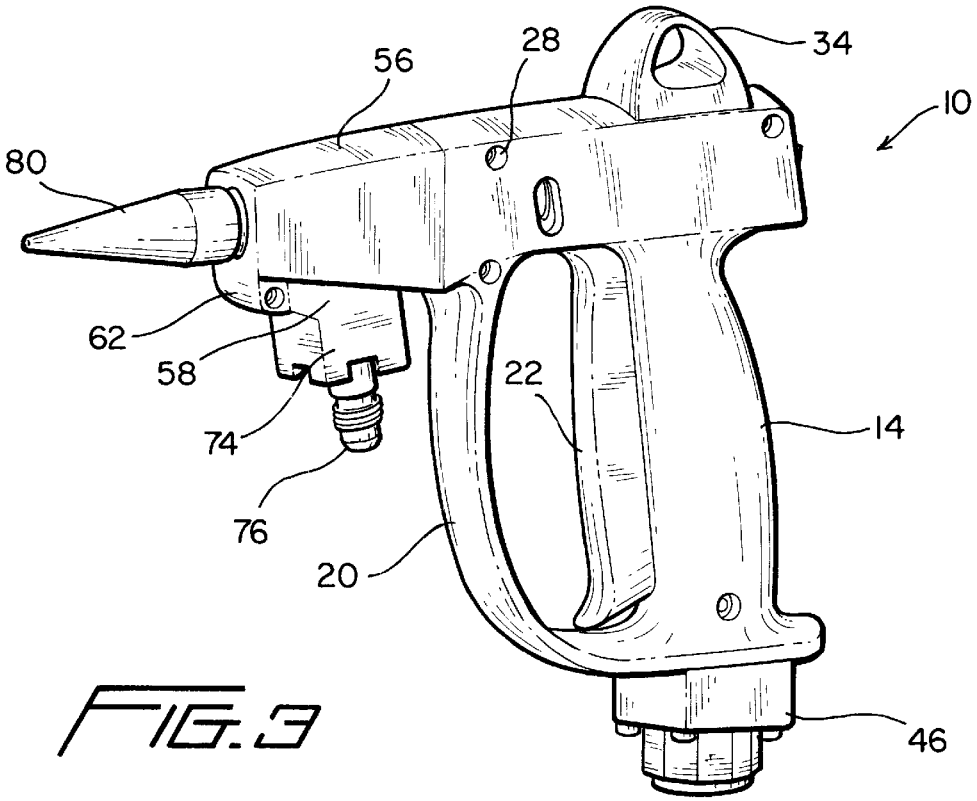
FIG. 3 is a perspective view of the new and improved hot melt adhesive applicator gun illustrated within FIG. 1 showing, however, the use of a different type of application nozzle.
Figure 6:
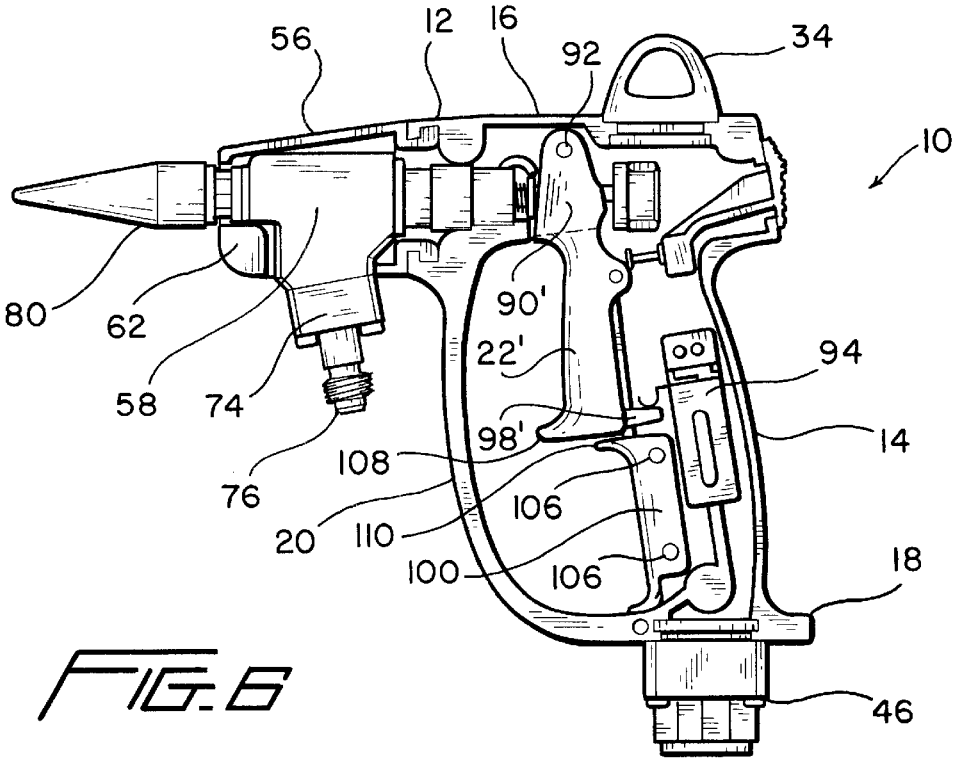
FIG. 6 is a side elevational view corresponding to that of FIG. 4 showing, however, the substitution of a two-finger trigger mechanism for the four-finger trigger mechanism illustrated in FIG. 4.

With reference now being made to FIGS. 1–4 and 6, an additional feature characteristic of the new and improved hot melt adhesive applicator gun 10 constructed in accordance with the principles and teachings of the present invention comprises the capability of the applicator gun 10 being optionally used with either a four-finger trigger member 22 as shown, for example, within FIGS. 1,3, and 4, or with a two-finger trigger member 22' as shown within FIGS. 2 and 6. The electrical power cable 54 comprises a plurality of electrical power wires, not shown, at least two of which are electrically connected to a cartridge heater assembly, not shown, and a temperature sensor assembly, also not shown, which are both operatively connected to the heater body member 58. In addition, an additional electrical power wire of power cable 54 is electrically connected to an electrical switch assembly 94 which, as best seen in FIG. 4, is fixedly mounted within the applicator gun handle 14 and is adapted to electrically control, for example, the operation of an adhesive supply gear pump, not shown, or alternatively, the operation of a compressed air supply, also not shown, used in conjunction with the adhesive supply. The electrical switch assembly 94 has a microswitch element 96 operatively associated therewith, and the four-finger trigger member 22 is seen to comprise a rearwardly projecting heel portion 98 upon which the microswitch element 96 rests. The left or trigger side of the applicator gun handle housing 14 is open or slotted, and accordingly, when the trigger member 22 is squeezed so as to in effect cause the same to pivot around the axis of the dowel pin 92, the trigger member 22 will partially move through the open slotted portion of the handle housing 14 whereby the heel portion 98 of the trigger member 22 will cause microswitch element 96 to close the switch assembly 94.

If a two-finger trigger member is desired to be utilized in lieu of the four-finger trigger member 22, then a two-finger trigger member 22' may be incorporated within the applicator gun 10 as illustrated in FIG. 6 as a result of being effectively exchanged for the four-finger trigger member 22. In order to accomplish such an exchange of trigger members 22,22', the mating half housing sections comprising the integral applicator gun housing 12 and the handle housing 14 can be initially separated by removing the fasteners 28, and the dowel pin 92 is then removed from the illustrated mating half housing section. Applicator gun trigger member 22 is then removed from the illustrated mating half housing section by effectively moving or sliding the trigger member 22 downwardly, and the new trigger member 22' is inserted into the illustrated mating half housing section in a manner reverse to that of removing the trigger member 22, whereupon dowel pin 92 is re-inserted. The mating half housing sections comprising the integral applicator gun housing 12 and the handle housing 14 can then be subsequently mated together by re-installing the fasteners 28, however, prior to the mating of the housing half sections, a filler member or insert 100 must be inserted within the handle housing 14. As can be appreciated from FIGS. 4 and 6, it is seen that the structure of the two trigger members 22,22' are substantially identical except for the fact that the longitudinal ex-tent of the two-finger trigger member 22' is only approxi-mately one-half of the longitudinal extent of the four-fing-er trigger member 22.

Consequently, remembering that the trigger side of the handle housing 14 is open or slotted, then if the filler member or insert 100 was not fixedly mounted within the handle housing 14 so as to effectively cover that portion of the open slot not taken up by the two-finger trigger member 22', the open slot might present an operative danger to, for example, the operator's third and fourth fingers while the first and second fingers are being used to operate the trigger member 22'. Accordingly, it is seen that each one of the mating half sections comprising the handle housing 14 has a pair of bosses 102,102 integrally formed upon an interior surface thereof, and each boss 102 is provided with a recessed or concave detent 104. The insert or filler member 100 is similarly provided upon opposite sides thereof with a pair of convex detents 106 which are adapted to be seated within the recessed or concave detents 104, and therefore, the filler member or insert 100 can be fixedly secured within the handle housing 14 when the mating half sections comprising the integral applicator gun housing 12 and the handle housing 14 are secured together by means of fasteners 28. It is to be further appreciated that in addition to preventing the operator's third or fourth finger from possibly being injured as a result of becoming caught or pinched within the otherwise open or slotted portion of the handle housing 14, the insert or filler member 100 also actually serves as a surface upon which such third and fourth fingers can rest comfortably while the first and second fingers of the operator are actually being used to operate the trigger member 22'. In conjunction with the structure of both the two-finger trigger member 22' and the insert or filler member 100, the trigger member 22' comprises a forward extending lower ledge portion 108 while the insert or filler member 100 similarly comprises a forward extending upper ledge portion 110 disposed immediately below the ledge portion 108 of the trigger member 22'. Such structures serve to in effect respectively seat the second and third fingers of the operator and maintain them separated so that neither one of such fingers can become jammed or pinched between the movable trigger member 22' and the fixed insert or filler member 100.

Figure 7:
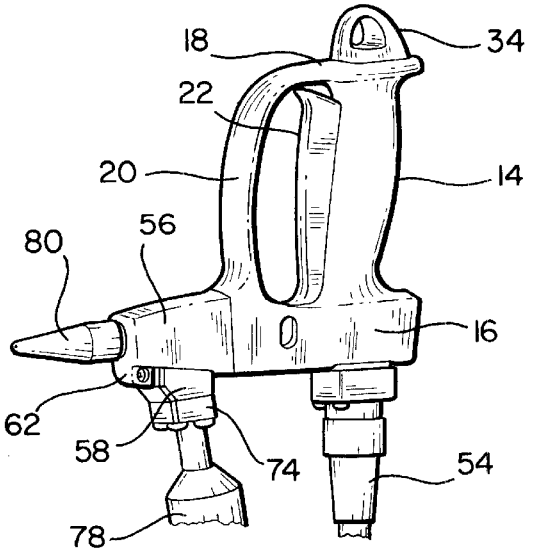
FIG. 7 is a perspective view similar to that of FIG. 3 wherein the hydraulic material supply hose, the electrical cable power supply, and the hanger bracket are disposed at their same locations and in their same orientations, however, the hot melt adhesive applicator gun per se is now disposed in an inverted mode.

It is lastly to be noted, in conjunction with the use of the two-finger trigger member 22' or the four-finger trigger member 22, that in view of the various aforenoted structure comprising the applicator gun 10 wherein, for example, the hanger bracket 34, the heater body housing 56, and the electrical power cable connector 46 can be disposed upon the applicator gun 10 in alternative positions or in alternative orientations, the applicator gun 10 itself can accordingly be inverted as disclosed within FIG. 7. However, when the applicator gun 10 is to be used within such an inverted mode as shown within FIG. 7, it is substantially imperative that the four-finger trigger member 22 be utilized in lieu of the two-finger trigger member 22' because if the two-finger trigger member 22' was to be used, then the trigger member 22' would have to in effect be operated by means of the operator's third and fourth fingers which may be operatively awkward.

Figure 8:
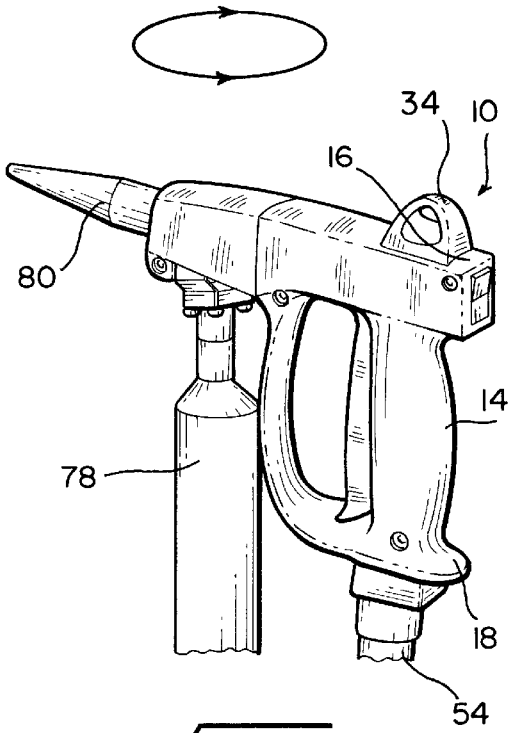
FIG. 8 is a perspective view of the hot melt adhesive applicator gun shown in FIG. 3 wherein the heater body assembly of the hot melt adhesive applicator gun has been fitted with a stem fitting assembly which permits the hot melt adhesive applicator gun to undergo rotational movements about a rotary axis defined by means of the stem fitting assembly.
Figure 10:
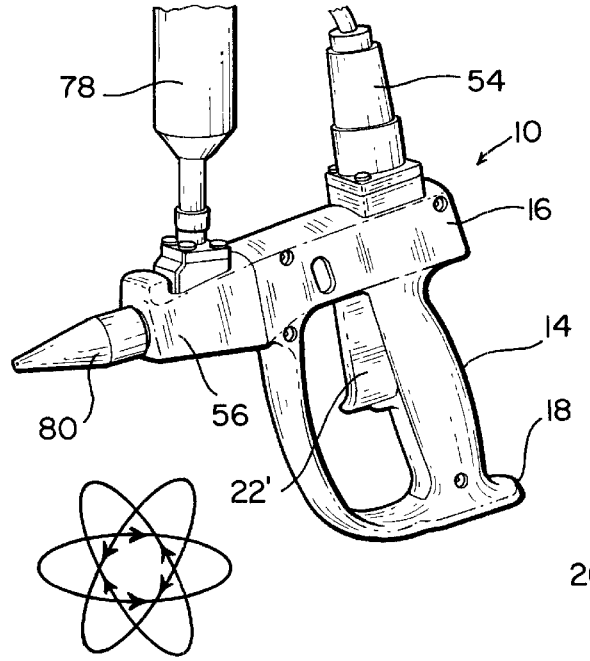
FIG. 10 is a perspective view of the hot melt adhesive applicator gun shown in FIG. 2 wherein the heater body assembly of the hot melt adhesive applicator gun has been fitted with a stem fitting assembly which permits the hot melt adhesive applicator gun to undergo movements comprising six degrees of freedom.

In accordance with a further unique feature characteristic of the new and improved hot melt adhesive applicator gun 10 constructed in accordance with the principles and teachings of the present invention, it is often desired to utilize the applicator gun 10 in a variety of movement modes or orientations around at least one axis as illustrated within FIG. 8, or still further, around three mutually orthogonal axes as shown within FIG. 10 which therefore provides the applicator gun 10 with movements having six degrees of freedom. With reference therefore now being made to FIG. 9, it is seen that in order to achieve rotational movement of the applicator gun 10 around a single axis 112 defined by means of the hydraulic material hose stem or connector 76, the heater body member 58 is provided with a recessed region 114 within which a thrust bearing seat member 116 is fixedly disposed.

The hose stem or connector 76 is provided with an annular flanged portion 118 at an axially central portion thereof, and a pair of thrust bearing assemblies 120, 122 are mounted upon opposite sides of the flanged portion 118. A plurality of roller bearings 124 are interposed between the inner peripheral surface of the annular stem fitting member 74 and the outer peripheral surface of the hose stem or connector 76, and in this manner, rotational movement of the hose stem or connector 76, and the hydraulic or adhesive material supply hose 78 operatively connected thereto, is facilitated and enabled. A static O-ring member 126 annularly surrounds the upper end portion of the thrust bearing seat member 116, and a pair of axially spaced O-ring members 128 are mounted upon the upper axial end portion of the hose stem or connector 76 so as to be rotatable therewith. Lastly, a plurality of screw fasteners 130 fixedly maintain the assembly of components mounted upon heater body member 58.

Figure 9:
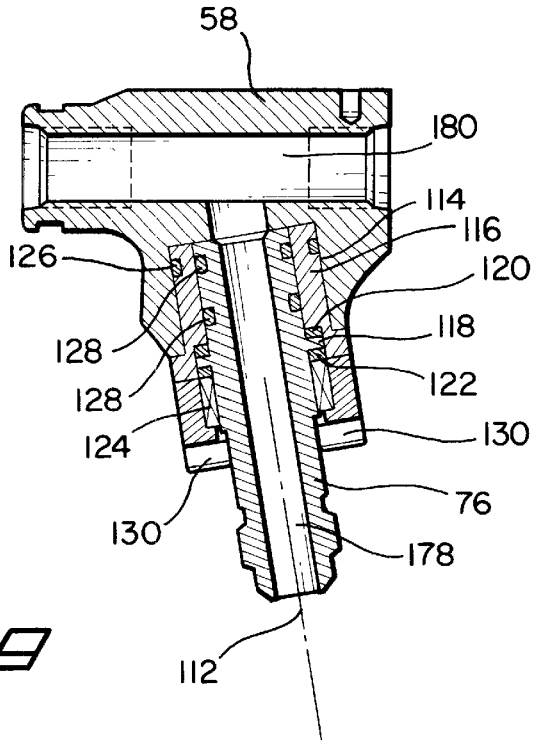
FIG. 9 is a cross-sectional view of the heater body assembly and the stem fitting assembly of the hot melt adhesive applicator gun which permits the hot melt adhesive applicator gun to undergo rotational movements about a rotary axis defined by means of the stem fitting assembly as has been illustrated in FIG. 8.
Figure 11:
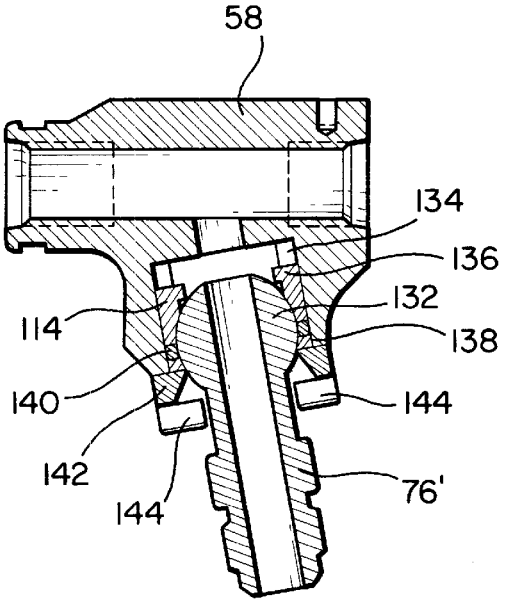
FIG. 11 is a cross-sectional view of the heater body assembly and the stem fitting assembly of the hot melt adhesive applicator gun which permits the hot melt adhesive applicator gun to undergo movements comprising six degrees of freedom as has been illustrated in FIG. 8.

With reference alternatively being made to FIG. 11, it is to be particularly noted that in the instance that it is desired to effectively convert the movement system for the applicator gun 10 from the system illustrated within FIG. 9, wherein rotation of the applicator gun 10 is permitted around axis 112, to a movement system for the applicator gun 10 such as that illustrated within FIG. 11 wherein movement of the applicator gun 10 is universally permitted around three mutually orthogonal axes, the same heater body member 58, having the same recessed region 114, is able to be utilized. In order to therefore effect the conversion of the movement system from the rotational system of FIG. 9 to the universal system of FIG. 11, the screw fasteners 130 are removed so as to effectively release or permit removal of all of the components mounted within the recessed region 114, and all of the components mounted within the recessed region 114 are then in fact removed. In lieu of such removed structural components, a hose stem or connector 76', having a universal ball unit 132 integrally provided upon the upper axial end portion thereof, is inserted within the recessed region 114. An annular wave washer or wave spring 134 is disposed within the upper axial portion of the recessed region 114, and an upper ball seat member 136 is also disposed within the recessed region 114. A lower ball seat member 138 is mounted within the mouth end portion of the heater body member 58 defining the recessed region 114, and an O-ring member 140 is interposed between the upper and lower ball seat members 136,138. An annular retainer member 142 is engaged with and mounted upon the mouth end portion of the heater body member 58, and a plurality of fasteners 144 are threadedly engaged within the heater body member 58 so as to retain all of the noted components at their respective positions. As a result of the aforenoted universal ball mounting structure, it is appreciated that the hydraulic or adhesive material hose stem or connector 76' will permit the applicator gun 10 to be universally moved around three mutually orthogonal axes.

Figure 12:
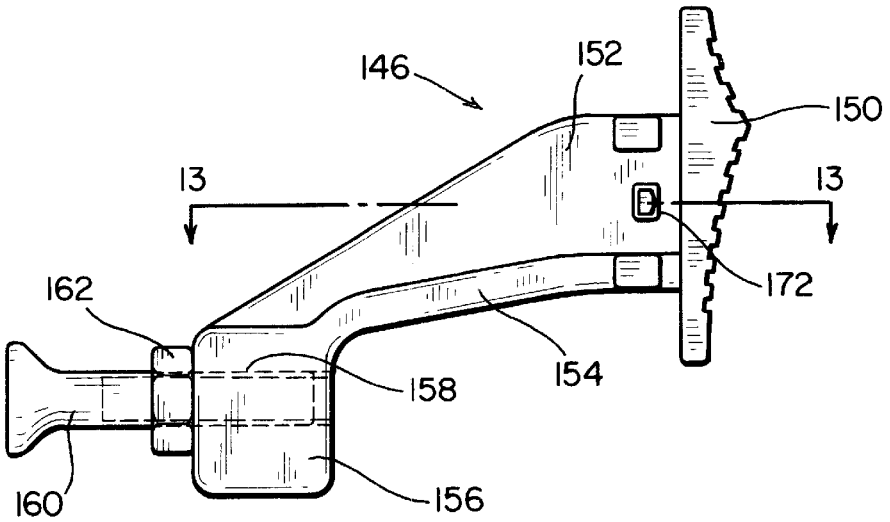
FIG. 12 is a side elevational view of a new and improved trigger lock assembly which may be incorporated within any one of the hot melt adhesive applicator guns illustrated in FIGS. 1–8 and 10.
Figure 13:
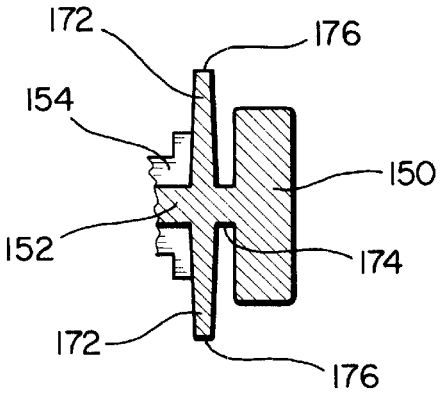
FIG. 13 is a cross-sectional view of the new and improved trigger lock assembly illustrated in FIG. 12 as taken along lines 13—13 of FIG. 12.

With reference now being made to FIGS. 4,12, and 13, the applicator gun 10 is further provided with a trigger lock mechanism 146 which is operatively mounted upon a rear surface 148 of the upper applicator gun housing section 16 so as to be movable, as denoted by means of the double arrowhead, between a raised UNLOCKED position and a lowered LOCKED position. In order to operate the trigger lock mechanism 146, the rear end of the mechanism 146 comprises an operator finger button 150, and it is seen that the operator finger button 150 is integrally connected to a vertically oriented web portion 152. The bottom region of the web portion 152 has a transversely extending rib member 154 integrally connected thereto, and a lock block 156 is integrally connected to forward end portions of the web portion 152 and the rib member 154. The lock block 156 is provided with a threaded through-bore 158, a threadedly adjustable lock pin 160 is threadedly mounted within the threaded through-bore 158, and in order to retain the lock pin 160 at a predetermined position, a lock nut 162 is threadedly mounted upon the lock pin 160. It is noted, as best seen, for example, from FIG. 4, that an upper end portion 164 of the handle housing 14 forms a heel and is integrally joined to a lower rear end ledge portion 166 of the upper applicator gun housing section 16. The trigger member 22 is also seen to comprise a pair of rearwardly extending lug portions or ears 168, and a transversely oriented pin 170 is mounted within the lugs or ears 168. Accordingly, it can be appreciated that when the trigger lock mechanism 146 is disposed in the UNLOCKED state as a result of the finger button 150 being moved to the raised position, the lock pin 160 will be disposed above the lug portions or ears 168 and the transverse pin 170 of the trigger member 22 thereby permitting the trigger member 22 to in effect be moved rearwardly as a result of being pivoted upon its dowel pin 92 when the trigger member 22 is squeezed by the operator. When, however, the trigger lock mechanism 146 is disposed in the LOCKED state as a result of the finger button 150 being moved to its lowered position, the lock block 156 will abut the heel portion 164 of the handle housing 14. In addition, the lock pin 160 will be engaged with the transverse pin 170 disposed within the trigger member lugs or ears 168, and therefore, rearward pivotal movement of the trigger member 22 is effectively prevented.

In accordance with a unique feature characteristic of the trigger lock mechanism 146 whereby a tactile indication is effectively provided to the operator when the operator moves the lock mechanism finger button 150 between the raised UNLOCKED position and the lowered LOCKED position, and as can be best appreciated from FIG. 13, the web portion 152 of the trigger lock mechanism 146 has a pair of oppositely extending transversely oriented detent fingers or arms 172. The portion of the web 152 which is defined between the finger button 150 and the detent fingers or arms 172 effectively forms a neck portion 174 which is adapted to be movably seated within a slotted portion, not shown, defined within the upper applicator gun housing section 16 so as to control or transversely confine the movement of the finger button 150 as the same is moved between the LOCKED and UNLOCKED positions. The tip portions 176 of the detent arms or fingers 172 are also adapted to operatively cooperate with recessed detents or notches, not shown, also defined upon interior surface portions of each mating half of the upper applicator gun housing section 16 such that when the trigger lock finger button 150 is moved to either one of its LOCKED or UNLOCKED positions, the detent tip portions 176 of the detent arms or fingers 172 will engage the recessed detents or notches, not shown, of the mating halves of the upper applicator gun housing section 16 in a tactile manner so as to indicate to the operator that the trigger lock finger button 150 has in fact achieved either one of the LOCKED and UNLOCKED states or positions.

Referring now back to FIGS. 5 and 9, when hydraulic or adhesive material is conducted into the heater body member 58 through means of a substantially radial bore 178 defined within the stem or connector 76, the hydraulic or adhesive material is further conducted into a second axial bore 180 which is formed within the heater body member 58 and within which the needle valve shank portion 84 is disposed. Accordingly, the needle valve shank portion 84 is enveloped within or surrounded by hydraulic or adhesive material whereby the hydraulic or adhesive material can in fact be discharged or dispensed from the nozzle 80 when the needle valve member 82 is unseated from its valve seat, not shown, defined within the nozzle 80. In order to normally prevent any leakage of the hydraulic or adhesive material from occurring in the rearward direction away from the nozzle 80, the needle valve return spring housing 86 has a needle valve seal assembly 182 fixedly mounted within a forward end portion thereof, and the needle valve seal assembly 182 has its forward end portion thereof fixedly mounted within the heater body member 58.

The needle valve seal assembly 182 has an axial bore 184 defined therein through which the needle shank portion 84 is movably disposed, and a recessed portion 186 is defined within the forward end portion of the needle valve seal assembly 182 so as to house a plurality of seal or packing members 188 which actually perform the sealing function around and with respect to the needle shank portion 84 so as to prevent the leakage of any of the hydraulic or adhesive material rearwardly toward and into the upper applicator housing section 16 and the handle housing section 14. The needle valve return spring housing 86 has an interior chamber 190 defined therein, and the needle shank portion 84 has a shoulder portion 192 formed thereon which is disposed within the chamber 190 of the needle valve return spring housing 86. A return spring 194 is also disposed within the chamber 190 and has a first end thereof operatively engaged with the shoulder portion 192 of the needle shank portion 84 while the second end of the return spring 194 is operatively engaged with one side of an interior shoulder portion 196 of the needle valve return spring housing 86.

In this manner, it is appreciated that the needle valve return spring 194 normally biases the needle valve member 82 toward its seated position with respect to nozzle 80. A trigger return spring collar 198 is movably mounted upon a rear end portion of the needle shank portion 84, and a coil return spring 200 is interposed between the collar 198 and the other side of the interior shoulder portion 196 of the needle valve return spring housing 86. The trigger member 22 has a portion thereof, not shown, which is adapted to be interposed between the return spring collar 198 and the needle pull collar 88, and in this manner, when the trigger member 22 is squeezed and pivoted in the counter-clockwise direction around dowel 92, the upper portion of the trigger member 22 defined between upstanding lugs or ears 90 acts upon needle pull collar 88, which is fixed upon the end of the needle shank portion 84 by means of a screw 202, so as to move needle pull collar 88 toward the right as viewed in FIG. 5 so as to unseat needle valve 82 from its valve seat, not shown, within the nozzle 80. When trigger member 22 is therefore released, needle valve return spring 194 will again seat the needle valve 82 upon its valve seat as a result of acting upon needle valve shoulder portion 192, and coil return spring 200 maintains the trigger member 22 engaged with the pull collar 88 as a result of acting upon the return spring collar 198. The trigger member 22 is therefore readied for a subsequent actuation movement.

Figure 14:
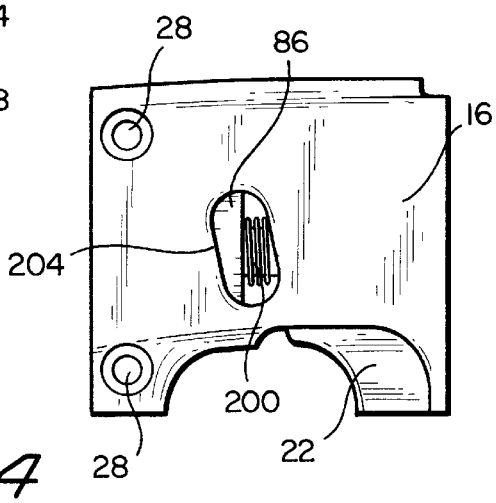
FIG. 14 is a partial side elevational view of the new and improved hot melt adhesive applicator gun as illustrated in FIG. 1 showing the location of the new and improved leakage-detection weep hole as defined in an enclosed manner within the upper applicator gun housing section.

If the seal or packing members 188 should deteriorate and fail, then as has been noted hereinbefore, the applicator gun 10 will experience hydraulic or adhesive material leakage into both the upper applicator gun housing section 16 and the handle housing 14 thereby fouling the component parts thereof. It is therefore important to detect any leakage as early as possible and to contain such leakage as best as possible so that fouling of applicator gun components, as well as external articles, is minimized. Therefore, in accordance with the last unique feature characteristic of the present invention applicator gun 10, a transversely oriented weep hole or window 204 is defined within or through the upper applicator gun housing section 16 such that, for example, as best seen in FIG. 14, the rearward portion of the needle valve return spring housing 86 and the coil return spring 200 are visible.

Accordingly, should the seal or packing members 188 deteriorate and fail whereby leakage of the hydraulic or adhesive material would tend to migrate or propagate rearwardly toward and into the upper applicator gun housing section 16 and the handle housing 14, then the weep hole or window 204 will afford an early warning or detection mechanism by means of which the operator can detect such leakage and take appropriate maintenance steps to correct such leakage, namely, taking apart the applicator gun 10 and replacing the seal and packing members 188 as required. In addition, it is also noted that since the weep hole or window 204 comprises an enclosed region, such structure effectively serves to contain for a predetermined period of time the leaking hydraulic or adhesive material such that the same does not also foul external portions of the applicator gun 10 or external articles present within the vicinity of the applicator gun 10.

Thus, it may be seen that in accordance with the principles and teachings of the present invention, there has been provided a new and improved applicator gun wherein various external connections, such as, for example, for the gun hanger bracket and electrical power cable, can be readily interchanged, as can the orientation of the hydraulic or adhesive material supply hose operatively associated with the heater body housing. In addition, as a result of such interchangeable or re-orientable connections, the applicator gun itself can be utilized within an inverted mode, and still further, the applicator gun can be equipped with either a four-finger trigger mechanism or a two-finger trigger mechanism. Accordingly, the applicator gun is capable of being used in a variety of orientations so as to satisfy spatial requirements, cable routing requirements, and the like. In addition, the heater body housing comprises internal structure which enables the applicator gun to be operated in both a rotational mode around a single linear axis, or alternatively, in a universal mode comprising movements having six degrees of freedom with respect to three mutually orthogonal axes. Still further, the applicator gun has unique tactile detent structure incorporated into its trigger lock mechanism so as to indicate to the operator the achievement of the LOCKED and UNLOCKED states, and lastly, the applicator gun has incorporated therein a weep hole or window for achieving early detection of the occurrence of the adhesive material leakage whereby the leakage of the adhesive material is not able to migrate or propagate into the applicator gun handle housing so as not to foul any of the components therein.

Obviously, many variations and modifications of the present invention are possible in light of the above teachings. For example, while it has been noted that one side portion of the handle housing 14 is open as a result of a slot being defined therein for accommodating the trigger members 22,22' when they are actuated to their squeezed positions, it is contemplated, for example, that only the upper half portion of the handle housing 14 needs to be slotted such that the heel portions 98,98' of the trigger members 22,22' can nevertheless be disposed internally within the handle housing 14 so as to actuate the microswitch element 96, whereas the bottom half portion of the handle housing 14 may be solid or otherwise closed. In the case wherein the four-finger trigger member 22 is being employed, the lower half of the trigger member 22, in lieu of partially entering the slotted portion of the handle housing 14, could be disposed externally of the handle housing 14 and effectively envelop or surround the lower external portion of the handle housing 14 when the trigger member 22 is moved to the actuated squeezed state. When the two-finger trigger member 22' is being employed, the solid or closed lower half of the handle housing 14 obviates the needs for a separate cover, filler, insert, or the like such as that disclosed at 100. In any case, the critically important characteristic of the handle housing 14 and the trigger members 22,22' mounted thereon resides in the fact that the lower portion of the handle housing 14 is always effectively covered in some manner or by some means so as to protect the operator's fingers. It is therefore to be understood that within the scope of the appended claims, the present invention may be practiced otherwise than as specifically described herein.

What is claimed as new and desired to be protected by Letters Patent of the United States of America, is:

1. An applicator gun for dispensing hydraulic material, comprising:

an applicator gun housing;

a handle housing mounted upon said applicator gun housing;

a hydraulic material supply hose for supplying hydraulic material to be dispensed by said applicator gun;

a body member fluidically connected to said hydraulic material supply hose;

a body housing within which said body member is disposed;

a dispensing nozzle fluidically connected to said body member for receiving hydraulic material from said body member and for dispensing the hydraulic material from said applicator gun;

means for mounting said body housing upon said applicator gun housing such that said body housing may be oriented in either one of two different orientation modes upon said applicator gun housing so as to in turn dispose said hydraulic material supply hose in either one of two different orientation modes upon said applicator gun housing; and means for alternatively mounting said hydraulic material supply hose upon said body housing so as to permit said applicator gun to be movable with respect to said hydraulic material supply hose in one of two alternative operative modes comprising a first rotational mode by means of which said applicator gun can rotate around a single rotational axis, and a second universal mode by means of which said applicator gun can be moved in accordance with six degrees of freedom about three mutually orthogonal axes.

2. The applicator gun as set forth in claim 1, wherein:

said body member comprises a heater body member for heating the hydraulic material prior to conducting the hydraulic material to said dispensing nozzle.

3. The applicator gun as set forth in claim 1, wherein:

said body member comprises a recessed portion;

a connector, for fluidically connecting said hydraulic material supply hose to said body member, is disposed within said recessed portion of said body member; and said means for mounting said hydraulic material supply hose upon said body housing so as to permit said applicator gun to be movable with respect to said hydraulic material supply hose in said first rotational mode by means of which said applicator gun can rotate around a single rotational axis comprises a rotary bearing system rotationally supporting said connector within said recessed portion of said body member.

4. The applicator gun as set forth in claim 1, wherein:

said body member comprises a recessed portion;

a connector, for fluidically connecting said hydraulic material supply hose to said body member, is disposed within said recessed portion of said body member; and said means for mounting said hydraulic material supply hose upon said body housing so as to permit said applicator gun to be movable with respect to said hydraulic material supply hose in said second universal mode by means of which said applicator gun can be moved in accordance with six degrees of freedom about three mutually orthogonal axes comprises a universal ball assembly supporting said connector within said recessed portion of said body member.

5. The applicator gun as set forth in claim 1, further comprising:

a hanger bracket having a connector portion integral therewith;

an electrical power cable having a connector portion integral therewith which is substantially identical to said connector portion of said hanger bracket; and connector means provided upon different locations of said applicator gun for mating with either one of said connector portions of said hanger bracket and said electrical power cable such that the locations of said hanger bracket and said electrical power cable upon said applicator gun can be exchanged.

6. The applicator gun as set forth in claim 1, further comprising:

means for alternatively mounting a four-finger trigger member, having a first predetermined length dimension, upon said handle housing such that said four-finger trigger member is movable between an actuation position and a de-actuation position, and a two-finger trigger member, having a second predetermined length dimension which is less than said first predetermined length dimension of said four-finger trigger member, upon said handle housing such that said two-finger trigger member is movable between an actuation position and a de-actuation position.

7. The applicator gun as set forth in claim 6, further comprising:

means disposed upon said handle housing, when said two-finger trigger member is mounted upon said handle housing, for covering the portion of said handle housing which is not covered by said two-finger trigger member due to the difference between said first and second predetermined length dimensions between said four-finger trigger member and said two-finger trigger member.

8. The applicator gun as set forth in claim 7, wherein:

one side portion of said handle housing has an open slot defined therein for accommodating said four-finger and two-finger trigger members are moved to said actuation position; and said means for covering said portion of said handle housing which is not covered by said two-finger trigger member comprises a filler insert which is disposed within said open slot defined within said handle housing.

9. The applicator gun as set forth in claim 1, further comprising:

a trigger member mounted upon said handle housing for movement between an inoperative non-squeezed state and an operative squeezed state;

a trigger lock mechanism movably disposed adjacent to said trigger member between a first UNLOCKED position for permitting said trigger member to be moved to said operative squeezed state, and a second LOCKED position for preventing said trigger member from being moved to said operative squeezed state; and detent means provided upon said trigger lock mechanism for providing an operator with tactile confirmation that said trigger lock mechanism is disposed at one of said first UNLOCKED and second LOCKED positions.

10. The applicator gun as set forth in claim 9, wherein said trigger lock mechanism comprises:

a trigger lock finger button; and a web portion integral with said trigger lock finger button;

said detent means comprises a pair of detent arms extending in opposite directions away from said web portion and having tip portions for engaging detents upon said applicator gun.

11. The applicator gun as set forth in claim 10, further comprising:

a trigger lock block integral with said web portion of said trigger lock mechanism and having a threaded bore defined therein; and a threaded lock pin threadedly disposed within said threaded bore of said trigger lock block so as to be positionally adjustable with respect to said trigger member.

12. The applicator gun as set forth in claim 1, further comprising:

a needle valve assembly operatively associated with said dispensing nozzle; and a trigger member operatively connected to said needle valve assembly and mounted upon said handle housing for movement between an inoperative non-squeezed state at which said needle valve assembly is disposed in a CLOSED state, and an operative squeezed state at which said needle valve assembly is disposed in an OPENED state.

13. The applicator gun as set forth in claim 1, further comprising:

an enclosed leakage detection window defined within said applicator gun housing for detecting leakage of the hydraulic material in a direction away from said dispensing nozzle and toward said handle housing so as to alert an operator of hydraulic material leakage prior to the hydraulic material fouling components of said applicator gun.

14. An applicator gun for dispensing hydraulic material, comprising:

an applicator gun housing;

a handle housing mounted upon said applicator gun housing;

a hydraulic material supply hose for supplying hydraulic material to be dispensed by said applicator gun;

a body member fluidically connected to said hydraulic material supply hose;

a dispensing nozzle fluidically connected to said body member for receiving hydraulic material from said body member and for dispensing the hydraulic material from said applicator gun; and means for alternatively mounting said hydraulic material supply hose upon said body member so as to permit said applicator gun to be movable with respect to said hydraulic material supply hose in one of two alternative operative modes comprising a first rotational mode by means of which said applicator gun can rotate around a single rotational axis, and a second universal mode by means of which said applicator gun can be moved in accordance with six degrees of freedom about three mutually orthogonal axes.

15. The applicator gun as set forth in claim 14, wherein:

said body member comprises a heater body member for heating the hydraulic material prior to conducting the hydraulic material to said dispensing nozzle.

16. The applicator gun as set forth in claim 14, wherein:

said body member comprises a recessed portion;

a connector, for fluidically connecting said hydraulic material supply hose to said body member, is disposed within said recessed portion of said body member; and said means for mounting said hydraulic material supply hose upon said body housing so as to permit said applicator gun to be movable with respect to said hydraulic material supply hose in said first rotational mode by means of which said applicator gun can rotate around a single rotational axis comprises a rotary bearing system rotationally supporting said connector within said recessed portion of said body member.

17. The applicator gun as set forth in claim 14, wherein:

said body member comprises a recessed portion;

a connector, for fluidically connecting said hydraulic material supply hose to said body member, is disposed within said recessed portion of said body member; and said means for mounting said hydraulic material supply hose upon said body housing so as to permit said applicator gun to be movable with respect to said hydraulic material supply hose in said second universal mode by means of which said applicator gun can be moved in accordance with six degrees of freedom about three mutually orthogonal axes comprises a universal ball assembly supporting said connector within said recessed portion of said body member.

18. The applicator gun as set forth in claim 14, further comprising:

a hanger bracket having a connector portion integral therewith;

an electrical power cable having a connector portion integral therewith which is substantially identical to said connector portion of said hanger bracket; and connector means provided upon different locations of said applicator gun for mating with either one of said connector portions of said hanger bracket and said electrical power cable such that the locations of said hanger bracket and said electrical power cable upon said applicator gun can be exchanged.

19. The applicator gun as set forth in claim 14, further comprising:

means for alternatively mounting a four-finger trigger member, having a first predetermined length dimension, upon said handle housing such that said four-finger trigger member is movable between an actuation position and a de-actuation position, and a two-finger trigger member, having a second predetermined length dimension which is less than said first predetermined length dimension of said four-finger trigger member, upon said handle housing such that said two-finger trigger member is movable between an actuation position and a de-actuation position.

20. The applicator gun as set forth in claim 19, further comprising:

means disposed upon said handle housing, when said two-finger trigger member is mounted upon said handle housing, for covering the portion of said handle housing which is not covered by said two-finger trigger member due to the difference between said first and second predetermined length dimensions between said four-finger trigger member and said two-finger trigger member.

21. The applicator gun as set forth in claim 20, wherein:

one side portion of said handle housing has an open slot defined therein for accommodating said four-finger and two-finger trigger members are moved to said actuation position; and said means for covering said portion of said handle housing which is not covered by said two-finger trigger member comprises a filler insert which is disposed within said open slot defined within said handle housing.

22. The applicator gun as set forth in claim 14, further comprising:

a trigger member mounted upon said handle housing for movement between an inoperative non-squeezed state and an operative squeezed state;

a trigger lock mechanism movably disposed adjacent to said trigger member between a first UNLOCKED position for permitting said trigger member to be moved to said operative squeezed state, and a second LOCKED position for preventing said trigger member from being moved to said operative squeezed state; and detent means provided upon said trigger lock mechanism for providing an operator with tactile confirmation that said trigger lock mechanism is disposed at one of said first UNLOCKED and second LOCKED positions.

23. The applicator gun as set forth in claim 22, wherein said trigger lock mechanism comprises:

a trigger lock finger button; and a web portion integral with said trigger lock finger button;

said detent means comprises a pair of detent arms extending in opposite directions away from said web portion and having tip portions for engaging detents upon said applicator gun.

24. The applicator gun as set forth in claim 23, further comprising:

a trigger lock block integral with said web portion of said trigger lock mechanism and having a threaded bore defined therein; and a threaded lock pin threadedly disposed within said threaded bore of said trigger lock block so as to be positionally adjustable with respect to said trigger member.

25. The applicator gun as set forth in claim 14, further comprising:

a needle valve assembly operatively associated with said dispensing nozzle; and a trigger member operatively connected to said needle valve assembly and mounted upon said handle housing for movement between an inoperative non-squeezed state at which said needle valve assembly is disposed in a CLOSED state, and an operative squeezed state at which said needle valve assembly is disposed in an OPENED state.

26. The applicator gun as set forth in claim 14, further comprising:

an enclosed leakage detection window defined within said applicator gun housing for detecting leakage of the hydraulic material in a direction away from said dispensing nozzle and toward said handle housing so as to alert an operator of hydraulic material leakage prior to the hydraulic material fouling components of said applicator gun.

27. An applicator gun for dispensing hydraulic material, comprising:

an applicator gun housing;

a handle housing mounted upon said applicator gun housing;

a hydraulic material supply hose for supplying hydraulic material to be dispensed by said applicator gun;

a body member fluidically connected to said hydraulic material supply hose;

a dispensing nozzle fluidically connected to said body member for receiving hydraulic material from said body member and for dispensing the hydraulic material from said applicator gun;

means for alternatively mounting a four-finger trigger member, having a first predetermined length dimension, upon said handle housing such that said four-finger trigger member is movable between an actuation position and a de-actuation position, and a two-finger trigger member, having a second predetermined length dimension which is less than said first predetermined length dimension of said four-finger trigger member, upon said handle housing such that said two-finger trigger member is movable between an actuation position and a de-actuation position; and means disposed upon said handle housing, when said two-finger trigger member is mounted upon said handle housing, for covering the portion of said handle housing which is not covered by said two-finger trigger member due to the difference between said first and second predetermined length dimensions between said four-finger trigger member and said two-finger trigger member.

28. The applicator gun as set forth in claim 27, wherein:

one side portion of said handle housing has an open slot defined therein for accommodating said four-finger and two-finger trigger members are moved to said actuation position; and said means for covering said portion of said handle housing which is not covered by said two-finger trigger member comprises a filler insert which is disposed within said open slot defined within said handle housing.

29. The applicator gun as set forth in claim 27, wherein:

either one of said four-finger and two-finger trigger members is mounted upon said handle housing for movement between an inoperative non-squeezed state and an operative squeezed state; and a trigger lock mechanism is movably disposed adjacent to said either one of said four-finger and two-finger trigger members between a first UNLOCKED position for permitting either one of said four-finger and two-finger trigger members to be moved to said operative squeezed state, and a second LOCKED position for preventing either one of said four-finger and two-finger trigger members from being moved to said operative squeezed state.

30. The applicator gun as set forth in claim 29, further comprising:

detent means provided upon said trigger lock mechanism for providing an operator with tactile confirmation that said trigger lock mechanism is disposed at one of said first UNLOCKED and second LOCKED positions.

31. The applicator gun as set forth in claim 30, wherein said trigger lock mechanism comprises:

a trigger lock finger button; and a web portion integral with said trigger lock finger button; and said detent means comprises a pair of detent arms extending in opposite directions away from said web portion and having tip portions for engaging detents upon said applicator gun.

32. The applicator gun as set forth in claim 31, further comprising:

a trigger lock block integral with said web portion of said trigger lock mechanism and having a threaded bore defined therein; and a threaded lock pin threadedly disposed within said threaded bore of said trigger lock block so as to be positionally adjustable with respect to said trigger member.

33. The applicator gun as set forth in claim 27, wherein:

a needle valve assembly is operatively associated with said dispensing nozzle; and either one of said four-finger and two-finger trigger members is operatively connected to said needle valve assembly and mounted upon said handle housing for movement between an inoperative non-squeezed state at which said needle valve assembly is disposed in a CLOSED state, and an operative squeezed state at which said needle valve assembly is disposed in an OPENED state.

34. The applicator gun as set forth in claim 27, further comprising:

an enclosed leakage detection window defined within said applicator gun housing for detecting leakage of the hydraulic material in a direction away from said dispensing nozzle and toward said handle housing so as to alert an operator of hydraulic material leakage prior to the hydraulic material fouling components of said applicator gun.

35. The applicator gun as set forth in claim 27, wherein:

said body member comprises a heater body member for heating the hydraulic material prior to conducting the hydraulic material to said dispensing nozzle.

36. An applicator gun for dispensing hydraulic material, comprising:

an applicator gun housing;

a handle housing mounted upon said applicator gun housing;

a hydraulic material supply hose for supplying hydraulic material to be dispensed by said applicator gun;

a body member fluidically connected to said hydraulic material supply hose;

a dispensing nozzle fluidically connected to said heater body member for receiving heated hydraulic material from said heater body member and for dispensing the hydraulic material from said applicator gun;

a trigger member mounted upon said handle housing for movement between an inoperative non-squeezed state and an operative squeezed state;

a trigger lock mechanism movably disposed adjacent to said trigger member between a first UNLOCKED position for permitting said trigger member to be moved to said operative squeezed state, and a second LOCKED position for preventing said trigger member from being moved to said operative squeezed state; and detent means provided upon said trigger lock mechanism for providing an operator with tactile confirmation that said trigger lock mechanism is disposed at one of said first UNLOCKED and second LOCKED positions.

37. The applicator gun as set forth in claim 36, wherein said trigger lock mechanism comprises:

a trigger lock finger button; and a web portion integral with said trigger lock finger button; and said detent means comprises a pair of detent arms extending in opposite directions away from said web portion and having tip portions for engaging detents upon said applicator gun.

38. The applicator gun as set forth in claim 37, further comprising:

a trigger lock block integral with said web portion of said trigger lock mechanism and having a threaded bore defined therein; and a threaded lock pin threadedly disposed within said threaded bore of said trigger lock block so as to be positionally adjustable with respect to said trigger member.

39. The applicator gun as set forth in claim 36, wherein:

a needle valve assembly is operatively associated with said dispensing nozzle; and said trigger member is operatively connected to said needle valve assembly such that when said trigger member is disposed at said inoperative non-squeezed state, said needle valve assembly is disposed in a CLOSED state, and when said trigger member is disposed at said operative squeezed state, said needle valve assembly is disposed in an OPENED state.

40. The applicator gun as set forth in claim 36, further comprising:

an enclosed leakage detection window defined within said applicator gun housing for detecting leakage of the hydraulic material in a direction away from said dispensing nozzle and toward said handle housing so as to alert an operator of hydraulic material leakage prior to the hydraulic material fouling components of said applicator gun.

41. An applicator gun for dispensing hydraulic material, comprising:

an applicator gun housing;

a handle housing mounted upon said applicator gun housing;

a trigger member mounted upon said handle housing for movement between an inoperative non-squeezed state and an operative squeezed state;

a hydraulic material supply hose for supplying hydraulic material to be dispensed by said applicator gun;

a body member fluidically connected to said hydraulic material supply hose;

a dispensing nozzle fluidically connected to said body member for receiving hydraulic material from said body member and for dispensing the hydraulic material from said applicator gun; and an enclosed leakage detection window defined within said applicator gun housing for detecting leakage of the hydraulic material in a direction away from said dispensing nozzle and toward said handle housing so as to alert an operator prior to the hydraulic material fouling components of said applicator gun.

42. The applicator gun as set forth in claim 41, wherein:

said body member comprises a heater body member for heating the hydraulic material prior to conducting the hydraulic material to said dispensing nozzle.

43. An assembly for incorporation within a tool so as to permit the tool to be connected to a connector in two different operative movement modes, comprising:

a body member;

a conduit connector; and means for alternatively mounting said conduit connector upon said body member so as to permit the tool to be movable with respect to said conduit connector in one of two alternative operative modes comprising a first rotational mode by means of which the tool can rotate around a single rotational axis, and a second universal mode by means of which the tool can be moved in accordance with six degrees of freedom about three mutually orthogonal axes.

44. The assembly as set forth in claim 43, wherein said means for mounting said conduit connector upon said body member so as to permit the tool to be movable with respect to said conduit connector in said first rotational mode by means of which the tool can rotate around a single rotational axis comprises:

a recessed portion defined within said body member;

a connector, for fluidically connecting said hydraulic material supply hose to said body member, disposed within said recessed portion of said body member; and a rotary bearing system rotationally supporting said connector within said recessed portion of said body member.

45. The assembly as set forth in claim 43, wherein said means for mounting said conduit connector upon said body member so as to permit the tool to be movable with respect to said conduit connector in said second universal mode by means of which the tool can be moved in accordance with six degrees of freedom about three mutually orthogonal axes, comprises:

a recessed portion defined within said body member;

a connector, for fluidically connecting said hydraulic material supply hose to said body member, disposed within said recessed portion of said body member; and a universal ball assembly supporting said connector within said recessed portion of said body member.

46. The assembly as set forth in claim 43, wherein:

said body member comprises a heater body member for heating hydraulic material prior to conducting the hydraulic material to a dispensing nozzle.

47. A trigger lock assembly for incorporation within a tool so as to be operatively associated with a trigger member mounted upon the tool for movement between an inoperative non-squeezed state and an operative squeezed state, comprising:

a trigger lock mechanism movably disposed adjacent to said trigger member between a first UNLOCKED position for permitting said trigger member to be moved to said operative squeezed state, and a second LOCKED position for preventing said trigger member from being moved to said operative squeezed state; and detent means provided upon said trigger lock mechanism for providing a tool operator with tactile confirmation that said trigger lock mechanism is disposed at one of said first UNLOCKED and second LOCKED positions.

48. The trigger lock assembly as set forth in claim 47, wherein said trigger lock mechanism comprises:

a trigger lock finger button; and a web portion integral with said trigger lock finger button; and said detent means comprises a pair of detent arms extending in opposite directions away from said web portion and having tip portions for engaging detents upon said applicator gun.

49. The trigger lock assembly as set forth in claim 48, further comprising:

a trigger lock block integral with said web portion of said trigger lock mechanism and having a threaded bore defined therein; and a threaded lock pin threadedly disposed within said threaded bore of said trigger lock block so as to be positionally adjustable with respect to said trigger member.

* * * * *